US008850712B2

(12) United States Patent
Laviolette et al.

(10) Patent No.: US 8,850,712 B2
(45) **Date of Patent: *Oct. 7, 2014**

(54) VACUUM DRYING METHOD

(76) Inventors: Thomas Brian Laviolette, Ortonville, MI (US); Jessica Lynn Laviolette, Ortonville, MI (US)

( * ) Notice: Subject to any disclaimer, the term of this patent is extended or adjusted under 35 U.S.C. 154(b) by 490 days.

This patent is subject to a terminal disclaimer.

(21) Appl. No.: 12/691,201

(22) Filed: Jan. 21, 2010

(65) Prior Publication Data

US 2010/0146808 A1 Jun. 17, 2010

Related U.S. Application Data

(63) Continuation of application No. 10/755,571, filed on Jan. 12, 2004, now Pat. No. 7,658,017.

(51) Int. Cl.
*F26B 11/00* (2006.01)

(52) U.S. Cl.
USPC ..... 34/90; 34/468; 156/230; 428/354; 118/634

(58) Field of Classification Search
USPC ..... 34/380, 403, 92, 97; 156/230, 304.1; 428/352, 354; 118/326, 634
See application file for complete search history.

(56) References Cited

U.S. PATENT DOCUMENTS

| | | | | |
|---|---|---|---|---|
| 1,534,738 | A * | 4/1925 | Roe | 34/423 |
| 1,606,442 | A | 11/1926 | Nichols | |
| 1,705,084 | A | 3/1929 | Draper | |
| 2,049,711 | A | 8/1936 | Lundy | |
| 2,108,017 | A | 2/1938 | Lithgow | |
| 2,116,884 | A | 5/1938 | Fisher | |
| 2,346,764 | A | 4/1944 | Kratz | |
| 2,498,339 | A | 2/1950 | Miskella | |
| 2,729,450 | A | 1/1956 | Clapham | |
| 2,777,782 | A | 1/1957 | Sheffer et al. | |
| 3,099,540 | A | 7/1963 | Eisler | |
| 3,133,828 | A * | 5/1964 | Slatkin | 427/500 |
| 3,228,113 | A | 1/1966 | Fannon, Jr. | |
| 3,237,314 | A | 3/1966 | Smith, Jr. | |
| 3,257,732 | A | 6/1966 | Webster | |
| 3,286,369 | A | 11/1966 | Smith, Jr. | |
| 3,346,417 | A | 10/1967 | Ehrlich | |
| 3,400,465 | A | 9/1968 | Von Stroh | |
| 3,401,466 | A | 9/1968 | Brewster | |
| 3,456,357 | A | 7/1969 | Griffith | |
| 3,574,949 | A | 4/1971 | Farnsworth | |
| 3,756,435 | A | 9/1973 | Steigerwald | |
| 3,803,111 | A | 4/1974 | Munro et al. | |
| 3,857,511 | A * | 12/1974 | Govindan | 239/11 |

(Continued)

FOREIGN PATENT DOCUMENTS

| | | | | |
|---|---|---|---|---|
| DE | 3936974 C1 * | 9/1990 | | B29B 13/00 |
| JP | 58133371 A * | 8/1983 | | C23C 13/02 |

(Continued)

*Primary Examiner* — Steve M Gravini
(74) *Attorney, Agent, or Firm* — Carlson, Gaskey & Olds, P.C.

(57) ABSTRACT

A vacuum drying apparatus and method to dry and cure paint is disclosed. The method provides a substantially particle free environment that shortens drying time, reduces cost and improves surface finish. The apparatus includes an enclosed drying tunnel that is maintained at a reduced pressure relative to ambient conditions. Heat lamps with the drying tunnel aid in curing and provide the desired particle free environment.

12 Claims, 1 Drawing Sheet

(56) References Cited

U.S. PATENT DOCUMENTS

| | | | | | |
|---|---|---|---|---|---|
| 3,973,665 | A | | 8/1976 | Giammanco | |
| 4,125,366 | A | | 11/1978 | Boyer | |
| 4,136,463 | A | | 1/1979 | Nolan et al. | |
| 4,199,492 | A | * | 4/1980 | Roth | 524/517 |
| 4,229,331 | A | * | 10/1980 | Zuckert | 524/539 |
| 4,370,534 | A | | 1/1983 | Brandon | |
| 4,546,553 | A | | 10/1985 | Best | |
| 4,608,401 | A | * | 8/1986 | Martin | 523/205 |
| 4,621,187 | A | | 11/1986 | Petro, Jr. | |
| 4,761,894 | A | | 8/1988 | Hamasaki et al. | |
| 4,771,086 | A | * | 9/1988 | Martin | 523/205 |
| 4,771,552 | A | | 9/1988 | Morioka | |
| 4,785,552 | A | * | 11/1988 | Best | 34/418 |
| 4,980,030 | A | | 12/1990 | Johnson et al. | |
| 4,988,537 | A | * | 1/1991 | Tanimoto et al. | 427/543 |
| 5,003,143 | A | | 3/1991 | Marks et al. | |
| 5,091,215 | A | * | 2/1992 | Tanimoto et al. | 427/240 |
| 5,095,811 | A | | 3/1992 | Shutic et al. | |
| 5,105,558 | A | | 4/1992 | Curry | |
| 5,113,600 | A | | 5/1992 | Telchuk | |
| 5,134,787 | A | | 8/1992 | Sprenger | |
| 5,147,422 | A | | 9/1992 | Neeley et al. | |
| 5,172,487 | A | | 12/1992 | Hansen et al. | |
| 5,229,010 | A | | 7/1993 | Fluchel | |
| 5,230,161 | A | | 7/1993 | Best | |
| 5,282,145 | A | | 1/1994 | Lipson et al. | |
| 5,326,808 | A | * | 7/1994 | Floyd et al. | 524/457 |
| 5,363,567 | A | | 11/1994 | Best | |
| 5,397,606 | A | | 3/1995 | Jeffs | |
| 5,398,425 | A | | 3/1995 | Cherry et al. | |
| 5,422,392 | A | * | 6/1995 | Floyd et al. | 524/457 |
| 5,444,029 | A | | 8/1995 | Martin | |
| 5,449,387 | A | * | 9/1995 | Hawkins et al. | 44/364 |
| 5,456,023 | A | | 10/1995 | Farnan | |
| 5,543,367 | A | * | 8/1996 | Narula et al. | 501/87 |
| 5,548,907 | A | | 8/1996 | Gourdine | |
| 5,556,466 | A | | 9/1996 | Martin et al. | |
| 5,568,692 | A | | 10/1996 | Crompton et al. | |
| 5,607,353 | A | | 3/1997 | Hutchings et al. | |
| 5,674,985 | A | * | 10/1997 | Hawkins et al. | 534/16 |
| 5,707,697 | A | * | 1/1998 | Spain et al. | 428/31 |
| 5,725,712 | A | * | 3/1998 | Spain et al. | 156/230 |
| 5,750,234 | A | * | 5/1998 | Johnson et al. | 428/141 |
| 5,806,704 | A | * | 9/1998 | Jamison | 220/212 |
| 5,836,085 | A | | 11/1998 | Ben-Ezra | |
| 5,953,832 | A | | 9/1999 | Rosynsky et al. | |
| 6,022,582 | A | * | 2/2000 | Van Tyle | 427/11 |
| 6,062,850 | A | | 5/2000 | Ino et al. | |
| 6,071,558 | A | | 6/2000 | Shutic | |
| 6,187,233 | B1 | * | 2/2001 | Smith | 264/75 |
| 6,192,604 | B1 | | 2/2001 | Morrison | |
| 6,284,183 | B1 | * | 9/2001 | Roys et al. | 264/345 |
| 6,349,754 | B1 | * | 2/2002 | Johnson et al. | 156/221 |
| 6,546,647 | B2 | | 4/2003 | Speck | |
| 6,551,432 | B1 | * | 4/2003 | Spain et al. | 156/230 |
| 6,579,397 | B1 | * | 6/2003 | Spain et al. | 156/230 |
| 6,602,591 | B1 | * | 8/2003 | Smith | 428/220 |
| 6,644,092 | B1 | | 11/2003 | Oppel | |
| 6,649,003 | B1 | * | 11/2003 | Spain et al. | 156/230 |
| 6,709,723 | B2 | * | 3/2004 | Roys et al. | 428/31 |
| 6,835,267 | B1 | * | 12/2004 | Spain et al. | 156/230 |
| 6,838,130 | B1 | * | 1/2005 | Spain et al. | 428/31 |
| 6,924,333 | B2 | * | 8/2005 | Bloom et al. | 524/315 |
| 6,966,962 | B2 | * | 11/2005 | Spain et al. | 156/230 |
| 6,984,280 | B2 | * | 1/2006 | Spain et al. | 156/230 |
| 6,990,749 | B2 | | 1/2006 | Roesler et al. | |
| 7,063,528 | B2 | | 6/2006 | Klobucar et al. | |
| 7,658,017 | B1 | * | 2/2010 | Laviolette et al. | 34/403 |
| 7,727,607 | B2 | * | 6/2010 | Shih et al. | 428/40.1 |
| 2002/0050665 | A1 | * | 5/2002 | Roys et al. | 264/345 |
| 2002/0054961 | A1 | * | 5/2002 | Spain et al. | 427/407.1 |
| 2003/0003282 | A1 | * | 1/2003 | Roys et al. | 428/213 |
| 2003/0187103 | A1 | * | 10/2003 | Bloom et al. | 524/35 |
| 2004/0123941 | A1 | * | 7/2004 | Spain et al. | 156/230 |
| 2004/0123942 | A1 | * | 7/2004 | Spain et al. | 156/230 |
| 2005/0196607 | A1 | * | 9/2005 | Shih et al. | 428/354 |
| 2007/0022625 | A1 | | 2/2007 | DeRegge et al. | |
| 2007/0093569 | A1 | * | 4/2007 | Goodall et al. | 523/116 |
| 2007/0154671 | A1 | * | 7/2007 | Shih et al. | 428/40.1 |
| 2009/0007452 | A1 | | 1/2009 | Cho | |
| 2009/0017408 | A1 | | 1/2009 | Pakkala et al. | |
| 2009/0107002 | A1 | | 4/2009 | Uhlyarik | |
| 2009/0170979 | A1 | * | 7/2009 | Goodall et al. | 524/18 |
| 2009/0242118 | A1 | * | 10/2009 | Holloway | 156/304.1 |
| 2009/0246364 | A1 | * | 10/2009 | Holloway | 427/142 |
| 2011/0086967 | A1 | * | 4/2011 | Helland et al. | 524/430 |

FOREIGN PATENT DOCUMENTS

| | | | | | |
|---|---|---|---|---|---|
| JP | 08000916 | A | * | 1/1996 | B01D 24/46 |
| JP | 09168767 | A | * | 6/1997 | B05D 7/14 |
| WO | WO 9964241 | A1 | * | 12/1999 | B32B 31/30 |

* cited by examiner

VACUUM DRYING METHOD

REFERENCE TO RELATED APPLICATION

This application is a continuation of U.S. application Ser. No. 10/755,571 filed on Jan. 12, 2004 now U.S. Pat. No. 7,658,017.

BACKGROUND OF THE INVENTION

This invention relates generally to the field of painting and more specifically to a method and device for drying and curing paint.

Automobile assembly plants use a clean room atmosphere for drying and curing paint applied to automotive components. Such clean room environments entail high maintenance and operational costs. Further, such clean room drying processes still produces defects in the paint that require costly repairs in order to provide an acceptable level of quality.

Accordingly, it is desirable to develop an improved method and device for effectively drying and curing a coating applied to an article.

BRIEF SUMMARY OF THE INVENTION

An example method and device according to this invention includes an enclosure maintained at a desired vacuum pressure for curing an applied coating such as paint.

The example method consists of drying a coating applied to a painted article, utilizing the steps of placing the painted article in an enclosure, controlling a first pressure within the enclosure such that the first pressure within the enclosure is lower than a second pressure outside the enclosure, and maintaining the first pressure within the enclosure to provide a desired condition of the coating applied to the painted article.

An example device according to this invention includes an enclosure with an inlet airlock and an outlet airlock. A painted article enters the inlet airlock and is sealed from an external environment. A vacuum is then generated within the inlet airlock that is equal to a vacuum pressure within the enclosure. Once the inlet airlock and the enclosure are of the same pressure, the painted article enters the enclosure and remains within the enclosure for a desired duration until the applied coating is cured as desired. The painted article is then removed through the outlet airlock back to ambient conditions.

The vacuum pressure within the enclosure removes undesirable particles and dust while also providing an environment that speeds the curing of the paint on the painted article.

Accordingly, the method and device according to this invention provides substantial improvements in paint quality and process efficiency.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of an example embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually an appropriately detailed system, structure or manner.

Figure 1:
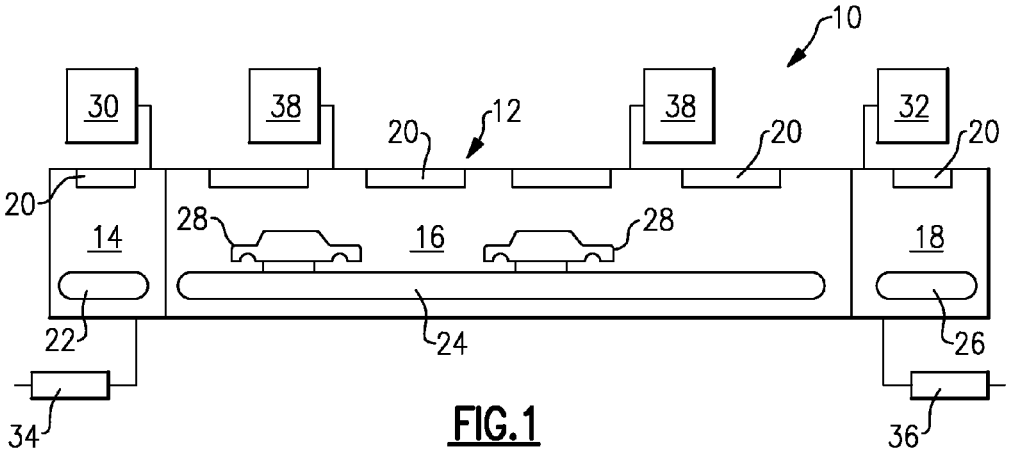
FIG. 1 is a schematic diagram illustrating the operation of a portion of the invention.

As shown in enclosed FIG. 1, an example vacuum paint drying apparatus 10 comprises a vacuum chamber 12 having an entry air lock 14, a drying tunnel 16 and an exit air lock 18. Radiant heat sources in the form of infrared or ultraviolet heat lamps 20 are arranged within the air locks 14 and 18, as well as along the drying tunnel 16. The air locks and drying tunnel 16 each have respective conveyors 22, 24 and 26 that transport items, such as automobile bodies 28, through the apparatus. Air locks 14 and 18 each include a high capacity vacuum pump 30 and 32, respectively, for rapidly pumping the air locks 14, 18 to a desired atmospheric pressure. The drying tunnel 16 includes a set of vacuum pumps 38 for maintaining a desired vacuum pressure within the drying tunnel 16.

In operation, the drying tunnel 16 is maintained below atmospheric pressure by vacuum pump sets schematically shown at 38 and the air locks 14 and 18 that isolate and seal the drying tunnel 16 from the ambient surrounding environment. The entry air lock 14 is initially at atmospheric pressure and open to the ambient surrounding environment. A freshly painted automobile body 28 enters the entry air lock 14 on conveyor 22, the air lock 14 is sealed from the ambient surrounding environment, the lamp 20 is turned on and the air lock 14 is pumped down to a desired pressure by the vacuum pump 30.

When the desired pressure in the entry air lock 14 is equal to the pressure in the drying tunnel 16, the air lock 14 is opened to the drying tunnel 16 and the automobile or other painted article is transferred from the conveyor 22 to the conveyor 24. Conveyor 24 moves the automobile body 28 through the drying tunnel 16, exposing the automobile body 28 to lamps 20 in a vacuum to dry and cure the paint.

When the automobile body 28 reaches the end of the drying tunnel 16, the exit air lock 18 is sealed from the ambient surrounding environment and pumped down using vacuum pump 32 to a pressure equal to the pressure within the drying tunnel 16. The exit lock 18 is opened to the drying tunnel 16 and the body 28 is transferred to the exit conveyor 26. The exit air lock 18 is then sealed from the drying tunnel 16 and vented to atmosphere through vent valve 36. When the pressure is equal to the ambient surrounding environment, the exit air lock 18 is opened to the ambient and the automobile body 28, painted and dried, is discharged from the vacuum drying apparatus 10. While the automobile body 28 is traversing the drying tunnel 16, the entry air lock 14 is isolated from the drying tunnel 16 and vented to atmosphere through vent valve 34. Once the pressure within the entry air lock 14 is equal to atmospheric, the entry air lock 14 is opened to the ambient to admit another automobile body 28. The process described above is then repeated, and the automobile bodies 28 are vacuum and heat dried in a continuous process. Note that drying takes place in both the entry air lock 14 and within the drying tunnel 16.

Figure 2:
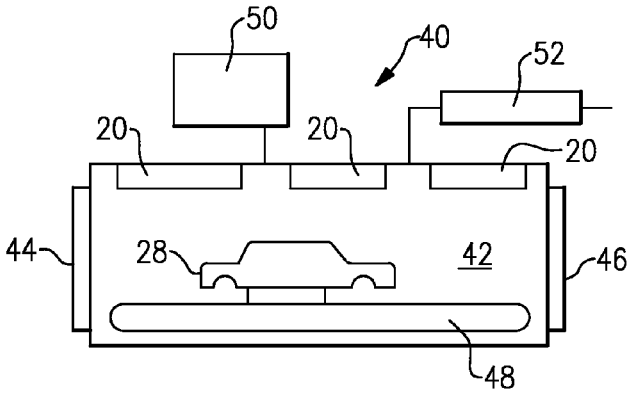
FIG. 2 is a schematic diagram illustrating the operation of a portion of the invention.

FIG. 2 shows another vacuum drying assembly 40 utilized in a batch mode drying operation. The vacuum drying assembly 40 includes a vacuum chamber 42 with doors 44 and 46 on either end. A conveyor 48 moves items such as automobile bodies 28, or other painted articles into and out of the chamber 42. The chamber 42 has radiant heat sources 20, a high capacity vacuum pump 50 and vent valve 52.

In operation, the chamber 42 is initially at atmospheric pressure with the door 44 opened to admit a freshly painted automobile body 28. The door 44 is then closed and the chamber 42 is pumped down by vacuum pump 50. The radiant heat sources 20 are turned on and the paint is dried to a desired level upon exposure to the heat and vacuum. When the drying is complete to the desired level, the chamber 42 is vented to atmosphere through vent valve 52. When the pressure within the chamber 42 is equal to atmospheric pressure, the door 46 is opened and the painted and dried automobile body 28 is removed from the chamber via conveyor 48.

This method and apparatus for drying and curing painted articles such as automobile bodies, is substantially cleaner as the disclosed inventive method provides an atmosphere substantially dust and particle free. Maintenance of the drying tunnel 16 and the air locks 14 and 18 is substantially less than that of a clean room type paint chamber. Further, the cycle time for curing painted articles within the drying chamber 16 is substantially shorter than current paint drying processes utilizing clean room drying tunnels, and therefore provides a faster drying time. Additionally, the disclosed inventive process provides an improved surface finish that results from the substantially particle free drying environment. Further, it should be understood that although paint is described in the disclosed example embodiment other coatings, such as primers, rust inhibitors, clear coats, and other substances applied to articles will benefit from the novel aspects of the disclosed inventive method and device.

While the invention has been described in connection with a preferred embodiment, it is not intended to limit the scope of the invention to the particular form set forth, but on the contrary, it is intended to cover such alternatives, modification, and equivalents as may be included within the spirit and scope of the invention as defined by the appended claims.

What is claimed is:

1. A method of drying paint applied to a painted article, comprising the steps of:

controlling a first pressure within an enclosure by drawing air from within the enclosure through a first outlet and preventing air from entering the enclosure through any opening within the enclosure such that the first pressure within the enclosure is lower than a second pressure outside the enclosure; and maintaining the first pressure within the enclosure to provide a selected drying time to dry paint applied to the painted article.

2. The method as recited in claim 1, wherein said step of controlling a pressure within the enclosure includes generating a vacuum within the enclosure relative to a pressure outside of the enclosure and preventing air outside the enclosure from entering the enclosure.

3. The method as recited in claim 1, including the step of applying heat to the painted article while disposed within the enclosure at the first pressure.

4. The method as recited in claim 2, wherein the enclosure includes a tunnel portion and an air lock portion, wherein the tunnel portion is maintained at the first pressure, and a pressure within the air lock portion selectively changes between the first pressure and the second pressure.

5. The method as recited in claim 4, including the steps of placing the painted article within the air lock portion at the second pressure, reducing pressure within the air lock portion to the first pressure, and moving the painted article from the air lock portion to the tunnel portion.

6. A paint drying assembly for curing a painted article comprising:

an enclosure that is sealed from conditions exterior to the enclosure for isolating and drying a painted article;

at least one vacuum pump for generating a vacuum within the enclosure, wherein the enclosure includes a first outlet for exhausting air from within the enclosure and preventing air from entering the enclosure; and at least one heat lamp for directing heat toward the painted article.

7. The assembly as recited in claim 6, including an entry airlock and an exit airlock providing for entry and exit to the enclosure while maintaining a desired first pressure within the enclosure.

8. The assembly as recited in claim 7, wherein each of the entry airlock and the exit airlock include an opening to an ambient environment and an opening to the enclosure.

9. The assembly as recited in claim 8, wherein each of the entry airlock and the exit airlock include an airlock vacuum pump for generating a pressure substantially equal to said desired first pressure within said enclosure.

10. The assembly as recited in claim 9, including a vent for selectively equalizing a pressure within each of the entry airlock and the exit airlock with ambient conditions.

11. The assembly as recited in claim 9, including a transfer mechanism for carrying painted articles from the entry airlock to the enclosure and from the enclosure to the exit airlock.

12. The assembly as recited in claim 9, wherein the painted article comprises an automobile body assembly.

* * * * *